US007722416B2

(12) United States Patent
Gump et al.

(10) Patent No.: US 7,722,416 B2
(45) Date of Patent: May 25, 2010

(54) ELECTRICAL CONNECTION SYSTEM FOR USE ON ALUMINUM WIRES

(75) Inventors: Bruce S. Gump, Warren, OH (US); William J. Palm, Warren, OH (US); Frank W. O'Malia, Fredonia, PA (US); George Albert Drew, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/286,789

(22) Filed: Oct. 2, 2008

(65) Prior Publication Data

US 2010/0087105 A1 Apr. 8, 2010

(51) Int. Cl.
*H01R 4/10* (2006.01)

(52) U.S. Cl. ..... 439/879

(58) Field of Classification Search ..... 439/879, 439/877, 882, 442

See application file for complete search history.

(56) References Cited

U.S. PATENT DOCUMENTS

| | | | | |
|---|---|---|---|---|
| 2,693,216 | A * | 11/1954 | Broske et al. | 72/412 |
| 2,735,997 | A * | 2/1956 | Peterson | 439/882 |
| 3,296,363 | A | 1/1967 | Laudig et al. | |
| 3,321,732 | A | 5/1967 | Forney, Jr. | |
| 3,510,829 | A * | 5/1970 | Keller | 439/421 |
| 3,758,703 | A | 9/1973 | Golden et al. | |
| 3,798,347 | A * | 3/1974 | Harding et al. | 174/84 C |
| 3,831,132 | A * | 8/1974 | Bowden et al. | 439/442 |
| 4,142,771 | A * | 3/1979 | Barnes et al. | 439/442 |
| 4,368,948 | A | 1/1983 | Despouys | |
| 4,427,252 | A | 1/1984 | Lee et al. | |
| 5,317,664 | A | 5/1994 | Grabiec et al. | |
| 5,749,756 | A * | 5/1998 | Vockroth et al. | 439/879 |
| 7,198,526 | B1 * | 4/2007 | MacNeil et al. | 439/881 |
| 7,402,751 | B2 * | 7/2008 | Haberman | 174/84 R |
| 7,484,294 | B2 * | 2/2009 | De Keyser et al. | 29/863 |
| 2005/0026515 | A1 * | 2/2005 | Hashimoto et al. | 439/877 |
| 2008/0230269 | A1 * | 9/2008 | Susai et al. | 174/84 C |

* cited by examiner

*Primary Examiner*—T C Patel
*Assistant Examiner*—Vladimir Imas
(74) *Attorney, Agent, or Firm*—Thomas N. Twomey

(57) ABSTRACT

A connection mechanism includes a metal segment in mechanical and electrical communication with the remainder of the connection mechanism on at least one side. The segment includes at least one tab protruding from the segment on a first side and a central area of the segment with a plurality of metal deformations. When the metal deformations are pressed into aluminum, they are capable of piercing through corrosion on the surface of the aluminum in order to make electrical contact with the aluminum.

7 Claims, 3 Drawing Sheets

ELECTRICAL CONNECTION SYSTEM FOR USE ON ALUMINUM WIRES

BACKGROUND

At the foundation of many electrical technologies is the ability to connect different electrical devices together. It is common to connect these electrical devices using some type of electrical cable assembly that includes an electrical conductor (such as wire or coax cable) and a conductive terminal connected to at least one end of the electrical conductor. The conductive terminal is typically "crimped" to the end of the conductor using a crimping tool, which effectively deforms the terminal around the conductor to form a firm connection. The crimped end of a conductor may also be referred to as a connector. In use, the terminal is used to connect the conductor to the electrical device. Often, the reliability of the electrical device depends in part on the quality of the connection created between the terminal and the conductor (i.e., the "crimp"). Thus, crimping not only provides for electrical connectivity, but also provides a mechanical connection for protection against torsional and tensional forces. These forces can damage the terminal or the wire and disrupt the electrical connection.

Known crimp-style connectors tend to use the force or pressure of the crimping action alone to make the electrical and mechanical connections between the terminal and the wire. This force however tends to damage or break either the wire or the terminal. If less crimping force is used to prevent damage or breakage, the electrical or mechanical connections may not be adequate for the needs of the system. Moreover, creating an effective electrical connection between the terminal and the conductor using a pressure contact method is impeded by various corrosion products on the surface of the terminal and the conductor. Various methods have been employed to overcome these impediments, but few have been successful in high volume manufacturing environments.

Another consideration is to create an electrical connection that is stable for long periods of time and over many different environmental factors. This often requires the initial mechanical connection to be able to overcome surface corrosion on both the wire and the terminal. This type of connection is especially difficult when aluminum wire is used due to the low hardness of the aluminum combined with corrosion products on the aluminum, which are often much harder than the aluminum itself.

Thus, there is a need for a connector that provides a firm electrical and mechanical connection without causing damage or breakage to the wire and/or terminal, and can overcome connection impediments due to corrosion.

BRIEF SUMMARY

A connection mechanism with a metal segment in mechanical and electrical communication with the remainder of the connection mechanism on at least one side, in which a central area of the segment has at least one tab protruding from each of two opposing sides of the segment. At least the central area includes a plurality of metal deformations which, when pressed into aluminum, are capable of piercing through corrosion on the surface of the aluminum in order to make electrical contact with the aluminum.

DETAILED DESCRIPTION OF THE INVENTION

A connector for establishing an electrical and mechanical connection to a conductor (i.e., wire, cable, etc.) includes a terminal with deformations or knurls, which when crimped around the conductor, provide an electrical connection between the terminal and the conductor notwithstanding corrosion that may be present on the conductor and/or terminal. The deformations also provide mechanical connection and strength when crimped around the conductor. In one exemplary approach, the terminal also includes a plurality of tabs having notches therebetween. The notches allow for the conductor to be partially redistributed through the notch area during the crimping process. For soft metals on which corrosion products have a tendency to build, e.g. aluminum, the notches allow for an increased amount of force to be applied during the crimping process than would be possible without the notches.

Figure 1A:
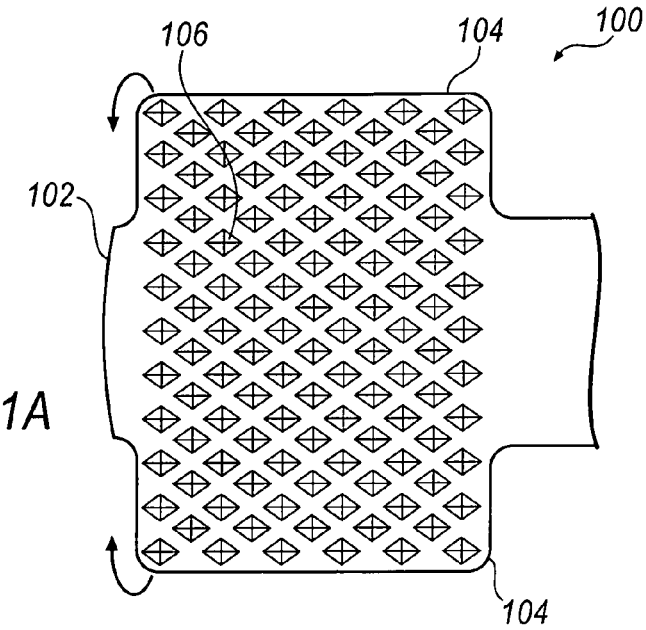
FIG. 1A illustrates a connector segment for crimping around a wire, with a knurled metal area and with one tab section on each side.

FIG. 1A illustrates a portion of a terminal 100 for crimping around a conductor. Segment 100 includes a knurled metal area including a plurality of knurls 106. The knurl 106 pattern of protuberances shown is representative, and may be any desired pattern. Different knurl 106 patterns will provide different electrical and/or mechanical connection properties. The knurl 106 pattern is also not limited to the area shown and can be extended or reduced in area to meet the needs of the application. Knurls 106 may be designed to make electrical and mechanical connection to a bare wire or, alternatively, to make connection by penetrating a coating on a wire and thereby contacting the wire. Knurls 106 may be replaced by any other deformation which provides the desired electrical and mechanical connection properties.

Segment 100 includes one tab section 104 on each side. The tab 104 size and shape as shown are representative, and may be adjusted according to the wire diameter or other parameters of interest. Tabs 104 are shown as mirror images of each other around an axis situated between the two sides and bisecting the distal end 102. This is an exemplary embodiment, and segment 100 is not limited to this description. Alternative embodiments of segment 100 may include tabs 104 on the two segment sides which are significantly distinct from each other.

Figure 1B:
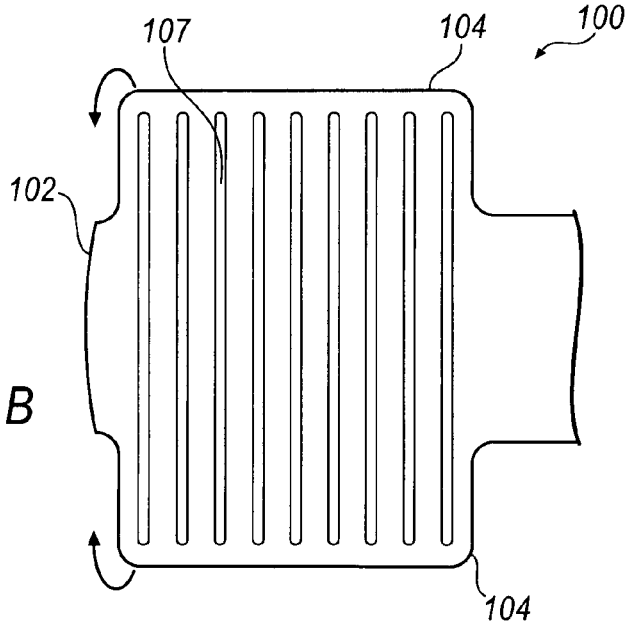
FIG. 1B illustrates a connector segment for crimping around a wire, with a ridged metal area and with one tab section on each side.

FIG. 1B illustrates a similar connector segment to that shown in FIG. 1A, but with the knurls 106 in a ridge 107 pattern. The number of ridges 107 may be selected according to relevant parameters, and is not limited to what is shown in the figure. Similarly, the dimensions and placement of the ridges 107 may be selected to fulfill the requirements of the application.

Figure 1C:
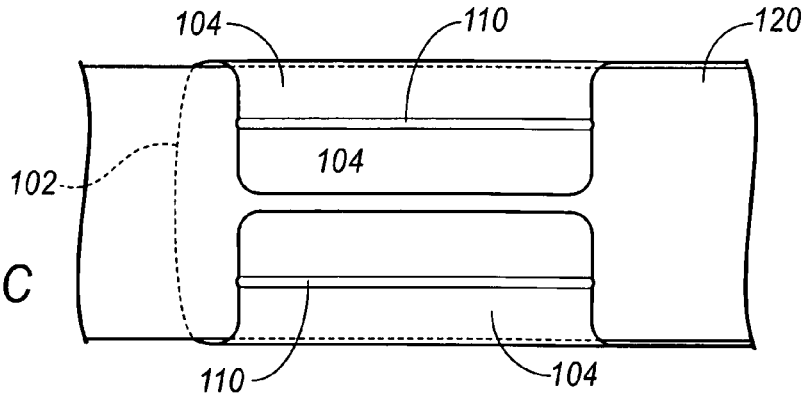
FIG. 1C illustrates a connector segment with one tab on each side wrapped around a wire.

FIG. 1C illustrates a connector segment such as the ones illustrated in FIGS. 1A and 1B after an exemplary crimping process has been performed on the segment. The tabs 104 are bent around and pressed firmly against wire 120. Tabs 104 may be designed to wrap only partially around wire 120, leaving a gap between the crimped tabs 104. Alternatively, tabs 104 may wrap significantly around wire 120, such that tabs 104 meet or overlap each other. The crimping process may leave marks in tabs 104, such as shown by exemplary creases 110. However, the crimping process may leave tabs 104 with substantially no marks.

Figure 2A:
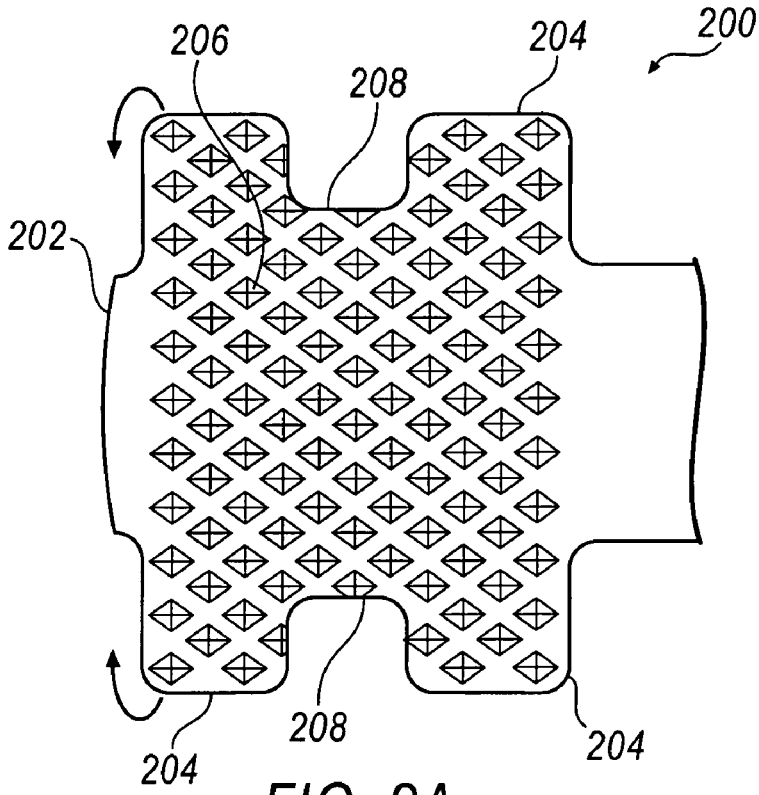
FIG. 2A illustrates a connector segment for crimping around a wire, with a knurled metal area and with two tab sections on each side.

FIG. 2A illustrates a connector segment 200 for crimping around a wire. Segment 200 is similar to connector segment 100 shown in FIG. 1A except that segment 200 has two tabs 204 with a notch 208 between. The width and shape of notches 208 may be defined as desired. Distal end 202 may terminate the segment 200 as shown, or may be in electrical and mechanical communication with the remainder of the connection mechanism in any form as is appropriate for the application. Knurls 206 cover an area of segment 200 as necessary for appropriate electrical and mechanical connection. Knurls 206 may be of any type or pattern, or may be replaced by any other deformation which provides the desired electrical and mechanical connection properties.

Segment 200 is exemplary for a connector segment with a plurality of tabs 204 and a corresponding number of notches 208. The number of tabs 204 may be a function of the wire diameter, the mechanical connection strength required, the desired electrical stability, or the like.

Figure 2B:
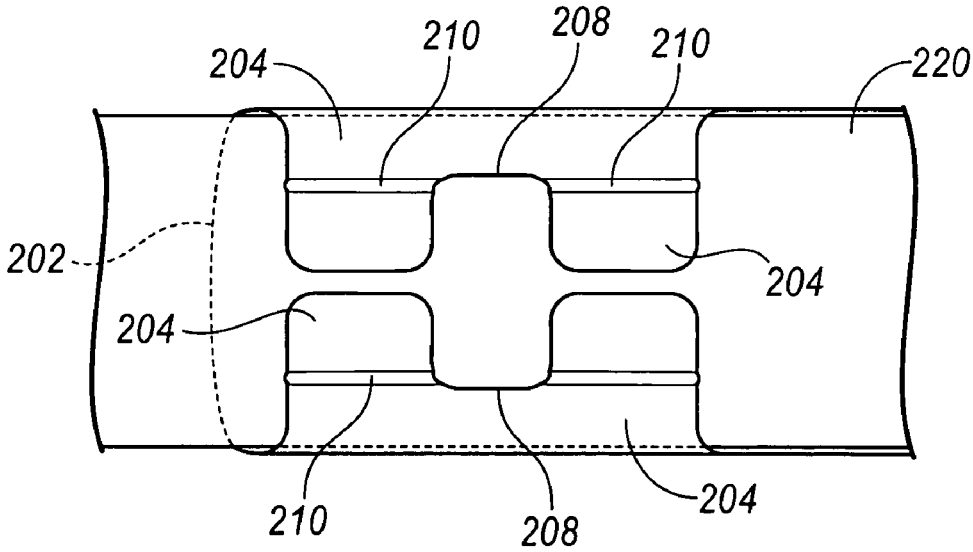
FIG. 2B illustrates a connector segment with two tabs on each side wrapped around a wire.

FIG. 2B illustrates the connector segment 200 of FIG. 2A after an exemplary crimping process is performed on the segment. Tabs 204 are bent around and pressed firmly against wire 220. Tabs 204 may be designed to wrap only partially around wire 220, leaving a gap between the crimped tabs 204. Alternatively, tabs 204 may wrap significantly around wire 220, such that tabs 204 meet or overlap each other. The crimping process may leave marks in tabs 204, such as shown by exemplary creases 210. However, the crimping process may leave tabs 204 with substantially no marks. Notches 208 between tabs 204 allow for the aluminum wire to displace when compressed by tabs 204, thus allowing enough force to be applied to tabs 204 for the knurls 206 to make electrical connection through the corrosion layer on the wire. The expansion of the wire into the notches also provides additional tensional strength to the connection.

Figure 3A:
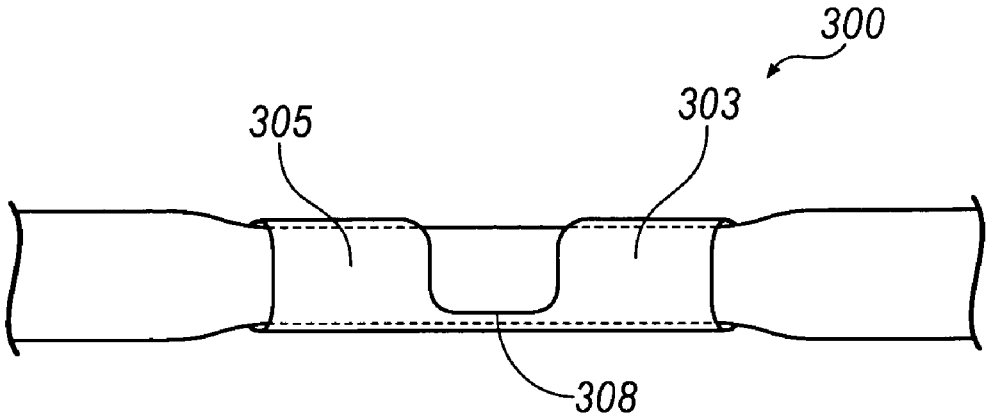
FIG. 3A illustrates a connector segment with two tabs on each side crimped around a wire and separated by notches, wherein the two tabs are crimped with different levels of force.

FIG. 3A illustrates another novel feature of a connector segment with a plurality of tabs. Segment 300, an embodiment of a segment such as segment 200, is shown from a side view perspective. Individual tab pairs 303 and 305, separated by notches 308, may each be crimped around the wire with a different force. Segment 300 is shown after a crimping process is complete which leaves the tab 303 pair with a larger effective circumference than the tab 305 pair. This may be necessary where the force required to make an electrical connection is greater than the force required to make a mechanical connection. Due to the shape of the remainder of the connection mechanism in relation to segment 300, some areas of segment 300 may be more easily damaged than others. A force great enough to make an electrical connection may cause segment 300 material, at e.g. tab pair 303, to be stressed to the point of damage. Therefore, for example, tab pair 303 may be crimped enough to make a mechanical connection only, whereas tab pair 305 may be crimped enough to also make an electrical connection in addition to the mechanical connection.

Segment 300 is not limited to two tabs 303 and 305, but may include as many tabs and corresponding notches as may be needed to meet the specifications for the connection mechanism. Each of the plurality of tabs may be crimped with a different force to allow for a stepped mechanical connection. The steps may be ascending or descending, or may alternatively be in any other pattern of steps up and steps down.

Figure 3B:
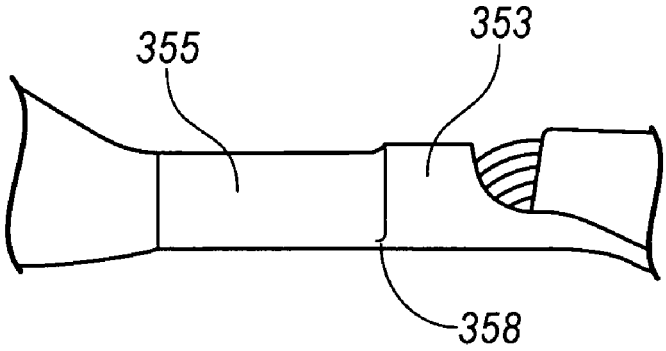
FIG. 3B illustrates a connector segment with two tabs on each side crimped around a wire, wherein the two tabs are crimped with different levels of force such that a step is formed.

FIG. 3B illustrates one such step pattern comprising two tab pairs 353 and 355 with very narrow notches between. Tab pair 355 is at a first stage of compression and tab pair 353 is at a second stage of compression as a result of using less crimping force on tab pair 353. There is a step 358 between crimped tab pair 353 and crimped tab pair 355.

In all of the figures, the tabs have been shown as being paired, one tab on each of the two tabbed sides, aligning with each other for crimping. However, it is not necessary that the tabs align, or that the tabs are of the same number, size or shape on the two sides.

The above description is intended to be illustrative and not restrictive. Many alternative approaches or applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

The present embodiments have been particularly shown and described, which are merely illustrative of the best modes. It should be understood by those skilled in the art that various alternatives to the embodiments described herein may be employed in practicing the claims without departing from the spirit and scope as defined in the following claims. It is intended that the following claims define the scope of the invention and that the method and apparatus within the scope of these claims and their equivalents be covered thereby. This description should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

What is claimed is:

1. A crimp terminal connection mechanism comprising:

a plurality of integrally formed tab sections axially spaced that extend laterally from a first side of said terminal connector with notches therebetween, said tab section being crimped onto exposed aluminum wire;

at least one of said plurality of integrally formed tab sections having a plurality of knurls integrally formed thereon;

at least one of said tabs with said knurls being crimped with a force about said exposed aluminum wire to pierce through corrosion on the surface of the aluminum wire in order to make electrical contact with said aluminum wire; and at least one other of said tabs being crimped with a lesser force about said exposed aluminum wire to provide a mechanical connection with said aluminum wire.

2. The crimp terminal connection mechanism of claim 1 wherein each knurl is either a ridge or a protuberance which is small with respect to the size of the central area on the segment.

3. The crimp terminal connection mechanism of claim 1 further comprising at least one integrally formed tab protruding laterally from an opposite second side of said terminal connection and having a plurality of knurls thereon that face knurls on a tab extending from said first side.

4. A crimp terminal connection mechanism as defined in claim 1 further comprising:

wherein said at least one said tab and said at least one other of said tabs being formed with a step therebetween at a respective notch between said two tabs.

5. A wire harness comprising:

a wire having an exposed terminal end section;

a connector on said one wire, the connector comprising:

a segment;

wherein the segment includes a plurality of integrally formed tabs with notches between the tabs, the tabs being crimped around an exposed terminal end of said wire;

wherein the segment is in mechanical and/or electrical communication with the remainder of the connection mechanism on at least one side;

at least one of said plurality of tabs including a plurality of integrally formed metal knurls and being crimped with a force to have said knurls pierce through corrosion on the surface of the exposed terminal end section of the wire in order to make electrical contact with the wire; and at least one other tab being crimped about said exposed terminal end of said exposed wire with less force than said at least one tab with said knurls.

6. The wire harness of claim 5 wherein the notches provide expansion capability for the aluminum when the tabs are pressed firmly into the aluminum to make electrical contact.

7. A wire harness as defined in claim 5 further comprising:

wherein said at least one said tab and said at least one other of said tabs being formed with a step therebetween at a respective notch between said two tabs.

* * * * *